United States Patent [19]

Zonneveld et al.

[11] Patent Number: 4,906,959

[45] Date of Patent: Mar. 6, 1990

[54] METHOD OF DIVIDING A SINTERED OXIDIC FERROMAGNETIC RING CORE AND A DEFLECTION UNIT

[75] Inventors: Maarten H. Zonneveld; Jacobus N. Dekker, both of Eindhoven, Netherlands

[73] Assignee: U.S. Philips Corporation, New York, N.Y.

[21] Appl. No.: 306,361

[22] Filed: Feb. 3, 1989

[30] Foreign Application Priority Data

Feb. 11, 1988 [NL] Netherlands ..... 8800334

[51] Int. Cl.[4] ..... H01F 7/00

[52] U.S. Cl. ..... 335/210; 219/121.67

[58] Field of Search ..... 335/210; 219/121.67, 219/121.7, 121.71, 121.72

[56] References Cited

U.S. PATENT DOCUMENTS 4,356,376 10/1982 Komananduri et al. .... 219/121.7 X
4,590,652 5/1986 Harwood ..... 219/121.67 X
4,818,840 4/1989 Booth et al. ..... 219/121.67 X

FOREIGN PATENT DOCUMENTS 0110888 5/1987 Japan ..... 219/121.67

*Primary Examiner*—George Harris

[57] ABSTRACT

The invention relates to a method of dividing a ring core (42) of sintered oxidic ferromagnetic material in two semi-annular parts, in which dividing seams 40, 41 are formed in the ring core 42 by means of two spot-shaped heat sources 43 and 44. The spot-shaped heat sources 43 and 44 are moved across the ring core 42 along the lines 40, 41 at a velocity v. An accurate and controlled division of the ring core 42 is obtained independent of the ratio between the heat supplied and the rate of movement v.

5 Claims, 3 Drawing Sheets

Figure 1:
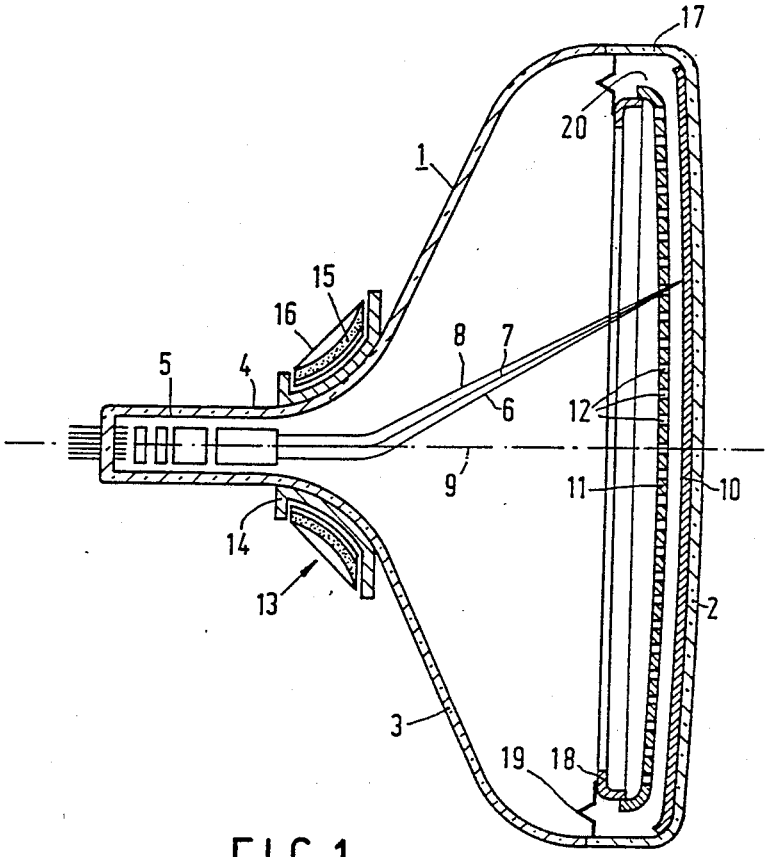

METHOD OF DIVIDING A SINTERED OXIDIC FERROMAGNETIC RING CORE AND A DEFLECTION UNIT

The invention relates to a method of dividing a sintered oxidic ferromagnetic ring core for a deflection in two semi-annular parts, the outside diameter of which ring core has different dimensions when measured in different planes extending perpendicularly to the longitudinal axis, the ring core being divided along two dividing seams.

The invention also relates to a ring core which is divided according to such a method and to a deflection unit for a display tube, comprising a ring core which is divided according to such a method.

A method of dividing a ring core of sintered oxidic ferromagnetic material (which is generally understood to means ferrites such as MnZn-ferrite, NiZn-ferrite and MgZn-ferrite) in two semi-annular parts is known from United States Patent Specification No. 4,471,261. According to this known method two grooves are ground in the ring core. To divide the ring core, in general, use is made of a gas flame or the ring core is subjected to mechanical stresses such as, for example, a blow, causing the ring core to part along two dividing seams at the location of the grooves. The ring core, which may be conically shaped or trumpet-shaped, has a large rigidity due to this shape. Owing to the said way of forming the grooves, stresses are introduced into the ring core which are released in an uncontrolled manner when applying the blow, thereby causing the division to be undefined in an undesirably large number of cases, i.e. not at the location of the ground grooves, which leads to too large a number of rejects. In the grinding operation of relatively thick ring cores (ring cores may have a wall thickness of 6 mm and more) relatively much mechanical force is required to form the grooves.

It is an object of the invention to provide a method of the type described in the opening paragraph, in which the division of a sintered oxidic ferromagnetic ring core takes place in a defined manner so as to allow the parts to be rejoined in a defined manner at a later stage.

To this end, a method of the type described in the opening paragraph is characterized in that each division seam is formed by means of a spot-shaped heat source which supplies heat locally to the surface of an end portion of the ring core to form thermally induced stress areas, and which is moved relative to the ring core along a line substantially in the direction of the longitudinal axis of the ring core which line defines a dividing seam, so that the thermally induced stress areas are moved across the ring core, a value being used for the ratio between the heat supplied and the relative velocity with which the heat source is moved, such that the ring core parts spontaneously and in a controlled manner along the division seam due to cracking caused by the thermally induced stress areas. Surprisingly it has been found that by using a laser, a ring core of sintered oxidic ferromagnetic material can be divided, in accordance with the invention, in a defined manner in two semi-annular parts. An additional advantage is that the ring core is not plastically deformed or melted during the formation of the division seam, so that an optimum joint is obtained when the semi-annular parts are subsequently rejoined.

Due to this, the ring core has a suitable magnetic flux conductance.

A preferred embodiment of a method according to the invention is characterized in that the line along which the thermally induced stress area is moved is a profile line. A further preferred embodiment of a method according to the invention is characterized in that, at least partly, a value is used for the ratio between the heat supplied and the relative velocity with which the heat source is moved, such that the deviation seam obtained exhibits, at least partly, a controlled corrugation. By making use of a controlled corrugation or a profiled line, an unambiguously defined positioning of the two parts of the divided ring core can be realized. This enables the parts to be rejoined in such a manner that they do not move relative to one another, consequently, the parts are rejoined in their original position relative to one another, so that the magnetic properties of the ring core are preserved. Moreover, it becomes possible to position the parts of the object relative to each other in a mechanized manner.

In a deflection unit for a display tube a ring core is used to control, together with a number of deflection coils, electron beams generated in the display tube. The deflection coils are provided around the ring core and, in order to facilitate this, the ring core is divided. After the deflection coils have been provided, the ring core parts are positioned against each other. In this process, a magnetic barrier may develop because the parts have moved relative to each other. If the ring core is divided according to the inventive method, the magnetic barrier is minimal when the parts are joined again. Thus, it has been found that a display tube comprising a deflection unit with a ring core which has been divided according to the invention functions properly.

Figure 2:
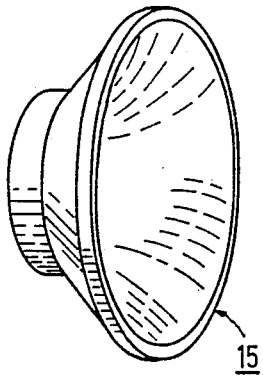
Figure 7:
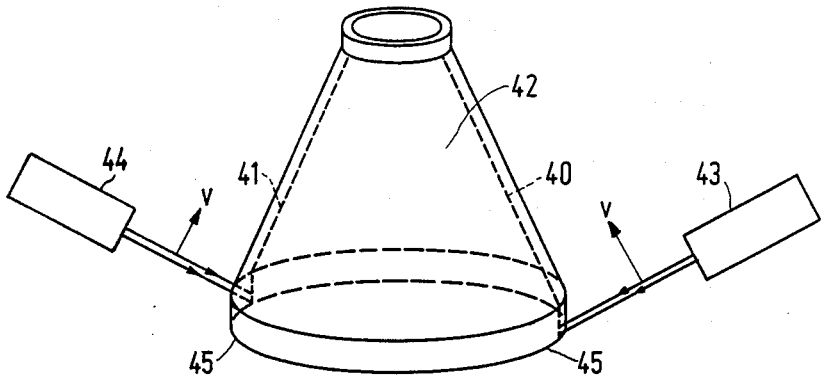
Figure 8:
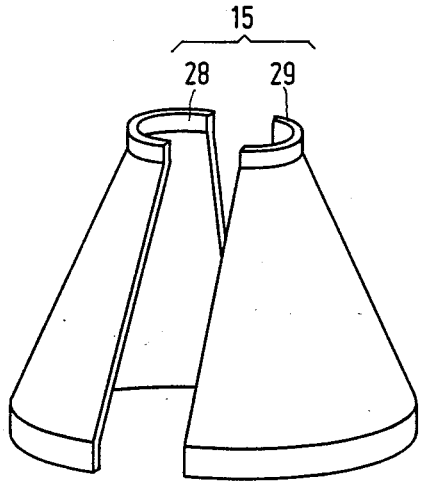
Figure 9:
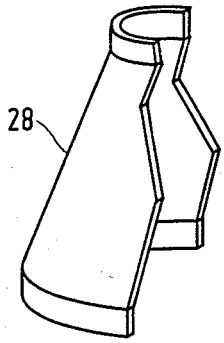
Figure 10:
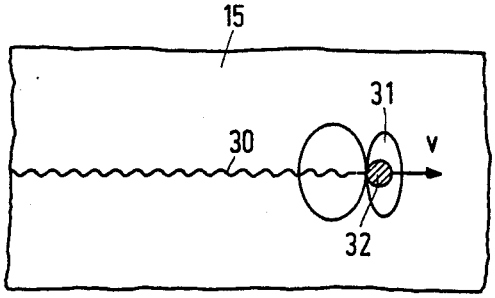

The invention will now be explained in greater detail by means of some exemplary embodiments and with reference to the drawing, in which FIG. 1 is a diagrammatic, longitudinal cross-sectional view of a display tube comprising a deflection unit, FIG. 2 is a diagrammatic, perspective view of an undivided ring core, FIGS. 3 up to and including 6 are diagrammatic representations of the inventive method of dividing a ring core, FIG. 7 is a diagrammatic representation of the formation of two division seams on a ring core, FIGS. 8 and 9 diagrammatically show a ring core which has been divided according to the inventive method, and FIG. 10 is a diagrammatic representation of a division along a corrugated line.

By means of the method according to the invention, a ring core of sintered oxide ferromagnetic material for a deflection unit can be divided.

FIG. 1 is a diagrammatic longitudinal cross-sectional view of a display tube. The display tube is a colour display tube of the "in-line" type having a glass envelope 1 which consists of a display window 2, a cone 3 and a neck 4. The neck 4 comprises an integrated electron gun system 5 which generates three electron beams 6, 7 and 8 whose axes are located in one plane prior to deflection. The axis of the electron beam 7 coincides with the axis of the tube 9. The display window 2 which has an upright edge 17 is provided on the inside with a large number of triplets of phosphor elements. Each triplet comprises an element consisting of a green luminescing phosphor, an element consisting of a red luminescing phosphor and an element consisting of a blue luminescing phosphor. The triplets together form the display screen 10. A colour selection electrode 11 is positioned in front of the display screen 10, in which color selection electrode a large number of apertures 12 have been made from which emerge the electron beams 6, 7 and 8 which each impinge on phosphor elements of one colour only, and which electrode is provided with a skirt 20. The skirt 20 of the colour selection electrode 11 is attached to a framework 18 which is suspended by schematically shown suspension means 19 in the corner of the upright edge 17 of the display window 2. The three coplanar electron beams are deflected by a deflection unit 13 which comprises a horizontal deflection coil 14, a ring core 15 of ferromagnetic material and a field deflection coil 16. The field deflection coil 16 is provided around the ring core 15. In order to facilitate the provision of the field deflection coil 16 around the ring core 15, the ferromagnetic ring core 15, as shown in FIG. 2, is divided in two. The ring core 15 is made of sintered, oxidic ferromagnetic material, for example MgMnZn-ferrite, LiMnZn-ferrite or NiZn-ferrite. When the outside diameter of the ring core 15 is measured in different planes extending perpendicularly to its longitudinal axis, this results in different values of said outside diameter. In other words, the ring core 15 is funnel-shaped. After the deflection coils have been provided around the parts of the ring core, the parts are joined. After they have been joined the ring core should possess a suitable conductivity of the magnetic flux. To this end it is necessary, amongst others, for the two parts to be accurately positioned against each other.

The ring core is divided by forming two division seams in the ring core by means of a spot-shaped heat source. An unfocussed laser beam or a hot gas flowing from a small pipe can for example be used as a spot-shaped source. In an alternative embodiment, heat can be supplied locally by means of inductive heating. By way of example, the invention is described using an unfocussed laser beam as a heat source. The method in accordance with the invention is described with reference to the FIGS. 3 up to and including 6, in which for clarity a description is given of the formation of only one division seam in the ring core 15.

Figure 3:
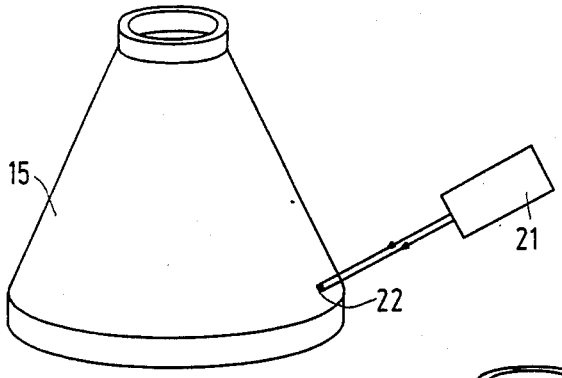
Figure 4:
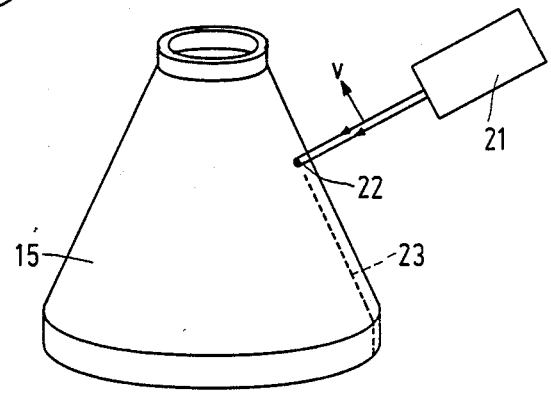
Figure 5:
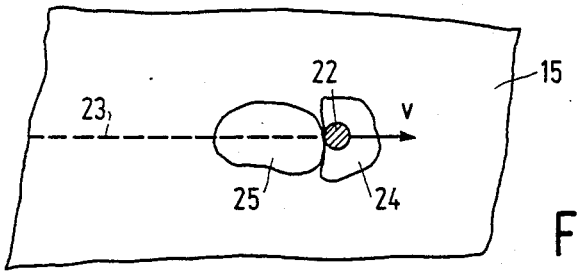
Figure 6:
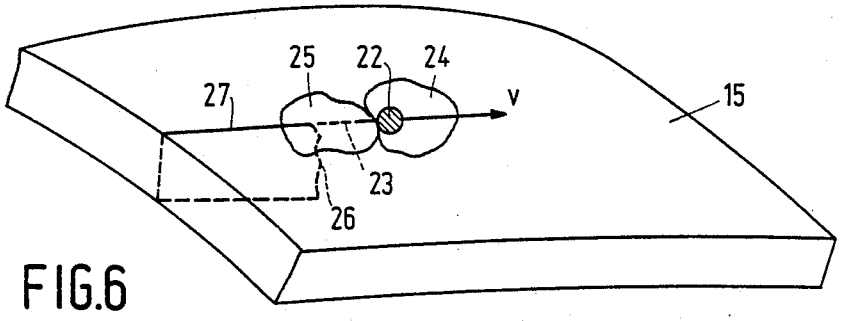

The division of the ring core 15 is obtained by directing an unfocussed laser beam emanating from a laser 21 to, for example, the outer wall of the ring core 15 as shown in FIG. 3. In this way, heat in the form of a spot-shaped area 22 is supplied locally to the ring core 15. The thermal expansion of the ferromagnetic material of the ring core 15 leads to the formation of stress areas. Subsequently, the laser 21 is moved relative to the ring core 15 along a line 23 substantially in the direction of the longitudinal axis of the ring core 15, as is shown in FIG. 4 by the interrupted line 23. This line 23 defines a division seam. In this way, the thermally induced areas are moved across the ring core at a velocity v, indicated in FIG. 4 by an arrow. The supply of heat and the transfer of the heat areas across the ring core leads to the formation of stress areas in the ring core 15, which are explained by means of FIG. 5. FIG. 5 shows a part of the ring core 15, in which the spot-shaped area 22 is moved along a line 23 at a velocity v. Due to thermal expansion of the ferromagnetic material of the ring core 15 a compressive stress area 24 is formed in the direction of movement of the spot-shaped area 22. This compressive stress area 24 is followed by a tensile stress area 25. By supplying heat, the tensile stresses in this tensile stress area 25 can be raised to a value at which the ferromagnetic material of the ring core 15 gives way, so that a crack front 26 is formed spontaneously, as is shown in FIG. 6. FIG. 6 is a perspective view of a part of the ring core 15. The crack front 26 is formed at some distance behind the spot-shaped area 22 and a crack 27 is formed behind the crack front 26. The crack 27 is prevented from taking an uncontrolled course by the compressive stress area 24 in front of the cracking area 26. The crack 27 is led along the line 23 in a controlled manner by the displacement of the spot-shaped area 22.

The formation of the crack front depends upon the heat supplied, which will hereinafter be called Q, and the velocity v with which the spot-shaped area is moved across the ring core. In dependence upon the ferromagnetic material of which the ring core is made, the ratio between the heat supplied Q and the displacement rate v plays an important part in the realization of a controlled division in the ring core. If the ratio Q:v is too small then the tensile stresses which develop in the tensile stress area are too small to form a crack front. If the ratio Q:v is too large, the large supply of heat leads to ferromagnetic material being melted and evaporated. The large heat supplied brings about too high tensile stresses in the ring core so that the latter may break in an uncontrolled manner. Thus, due to the evaporation of ferromagnetic material no unambiguous position of the two parts of the ring core relative to each other is obtained.

By using an appropriate value for the ratio between the heat supplied Q and the displacement velocity v a controlled crack formation is obtained. The proper ratio Q:v depends on the ferromagnetic material of which the ring core is made and, hence, can be determined in dependence upon the material.

A controlled division of the ring core is obtained by directing two unfocussed laser beams emanating from two lasers 43 and 44 to the surface of one end 45 of the ring core 42, as is shown in FIG. 7. The heat supplied by the laser beams can be supplied to both the outside wall and the inside wall of the ring core 42. Starting from the end of the ring core 42, the heat supply is subsequently led across the ring core, along the lines 40 and 41, substantially in the direction of the longitudinal axis of the ring core 42. The lines 40 and 41 define the division seams along which the ring core 42 is divided. The ratio between the heat supplied and the relative velocity with which the laser beam are moved across the ring core is such that the ring core parts spontaneously along the division seams 40 and 41 as a consequence of crack caused by thermally induced stress areas (as described above). Due to this controlled division along the lines, in which process no ferromagnetic material is evaporated or melted, the two parts 28 and 29 of the ring core 15 (see FIG. 8) can be accurately positioned against each other. If the line along which the thermally induced spot-shaped stress area extends is profiled, for example zigzag-shaped, then one part 28 of the ring core is obtained, as is shown in FIG. 9, leading to an unambiguous positioning of the two parts relative to each other. Of course, the line may also have other profiled shapes. Thus, the two parts can be joined after having been accurately positioned relative to each other. Due to this, the magnetic barrier is minimal. Moreover, the two parts formed can be positioned relative to each other mechanically.

If a larger value is used for the ratio Q:v, then the ring core 15 is divided in a controlled manner along a line 30, the line 30 having a controlled corrugation (see FIG.

10). In practice it has been found that the amplitude of the corrugation depends upon the ratio Q:v. The corrugation permits an unambiguous positioning of the two parts of the ring core relative to one another. For an unambiguous positioning it suffices if the division is carried out, at least partly, at a ratio Q:v, such that a controlled corrugation is obtained and the ring core is divided along a division seam which exhibits, at least in part, a corrugation.

In practice, ring cores of different ferromagnetic materials and having different wall thicknesses are known. In an exemplary embodiment, ring cores of MgZn ferrite having a wall thickness of 3.5 mm were divided according to the inventive method. As a heat source a continuous $CO_2$ laser having a wavelength of 10.6 $\mu$m was used, providing an unfocussed laser spot having a diameter between 1 and 10 mm, and 6 mm in a specific case, on the ring core. In practice it was found that a controlled crack formation, i.e. a controlled division of the ring core, is obtained at a ratio between the heat supplied Q in Watt and a relative rate of displacement v in mm per minute in the range between 0.05 and 1.0. In practice it was found that a controlled division, in which a corrugation is formed, took place at a ratio Q:v in the range between 0.2 and 1.0. If a value smaller than 0.05 was used for the ratio Q:v then no division took place, if a value larger than 1.0 was used for the ratio Q:v then an insufficiently controlled division took place.

For use in a deflection unit, the two parts of the ring core are positioned against each other. Owing to the accurately controlled division the two parts fit accurately together so that the magnetic barrier formed due to the division of the parts is minimal. The parts can be attached to one another, for example, by means of an adhesive. A deflection unit comprising a ring core which has been divided according to the inventive method and, hence, a display tube comprising such a deflection unit, operate satisfactorily.

The invention has been described by means of a colour television tube. However, it will be clear that a deflection unit comprising a ring core which has been divided according to the inventive method can also be applied in a monochrome television tube or in another type of display tube.

We claim:

1. A method of dividing a ring core of sintered oxidic ferromagnetic material for a deflection unit in two semi-annular parts, which outside diameter of which ring core has different dimensions, measured in different planes extending perpendicularly to its longitudinal axis, the ring core being parted along two dividing seams, characterized in that each division seam is formed by means of a spotshaped heat source which supplies heat locally to the surface of an end of the ring core to form thermally induced stress areas, and which is moved relative to the ring core along a line substantially in the direction of the longitudinal axis of the ring core, which line defines a division seam, such that the thermally induced stress areas are moved across the ring core, a value being used for the ratio between the heat supplied and the relative velocity with which the heat source is moved such that the ring core parts spontaneously and in a controlled manner along the division seam due to cracking caused by the thermally induced stress areas.

2. A method as claimed in claim 1, characterized in that a profiled line is used for the line along which the thermally induced stress area is moved.

3. A method as claimed in claim 1 or 2, characterized in that the ratio between the heat supplied and the relative velocity with which the heat source is moved, is chosen so that the division seam exhibits, at least on part, a controlled corrugation.

4. A ring core which is divided according to the method as claimed in claim 3, characterized in that each division seam exhibits, a corrugation.

5. A deflection unit for a picture tube, comprising a ring core which is divided according to the method as claimed in claim 1, characterized in that each division seam exhibits, a corrugation.

* * * * *

UNITED STATES PATENT AND TRADEMARK OFFICE

CERTIFICATE OF CORRECTION

PATENT NO. : 4,906,959

DATED : MARCH 6,1990

INVENTOR(S) : MAARTEN H. ZONNEVELD ET AL

It is certified that error appears in the above-identified patent and that said Letters Patent is hereby corrected as shown below:

IN THE ABSTRACT

Title page: line 7, delete "independent and substitute therefor: --by an appropriate choice of--.

Signed and Sealed this

First Day of October, 1991

*Attest:*

HARRY F. MANBECK, JR.

*Attesting Officer*

*Commissioner of Patents and Trademarks*